US005318301A

United States Patent [19]

Asch

[11] Patent Number: 5,318,301

[45] Date of Patent: Jun. 7, 1994

[54] THREE-DIMENSIONAL PUZZLE

[76] Inventor: Sabine Asch, Heilbronner Strasse 100, 7120 Beitigheim-Bissingen, Fed. Rep. of Germany

[21] Appl. No.: 969,258

[22] PCT Filed: Aug. 24, 1991

[86] PCT No.: PCT/EP91/01605

§ 371 Date: Feb. 22, 1993

§ 102(e) Date: Feb. 22, 1993

[87] PCT Pub. No.: WO92/03195

PCT Pub. Date: Mar. 5, 1992

[30] Foreign Application Priority Data

Aug. 28, 1990 [DE] Fed. Rep. of Germany ... 9012333[U]

[51] Int. Cl.[5] ..... A63F 9/08

[52] U.S. Cl. ..... 273/153 P; 273/155

[58] Field of Search ..... 273/153 R, 153 S, 155, 273/156, 157 R, 160, 153 P; 446/124, 125

[56] References Cited

U.S. PATENT DOCUMENTS

| | | | |
|---|---|---|---|
| D. 206,336 | 11/1966 | Wilson | 273/160 |
| 1,050,141 | 1/1913 | Joy | 273/156 |
| 1,997,022 | 4/1933 | Stalker . | |
| 3,201,894 | 8/1965 | Resch | 273/155 |
| 3,487,578 | 4/1967 | Sudermann . | |
| 3,746,345 | 7/1973 | Palazzolo | 273/155 |
| 3,800,442 | 4/1974 | Petrocelli | 273/155 |
| 4,020,205 | 4/1977 | Haselbauer | 273/155 |
| 4,219,958 | 9/1980 | Shulyak | 273/155 |
| 4,643,427 | 2/1987 | Wozniak | 273/160 |
| 4,944,402 | 7/1990 | Wu | 206/581 |

FOREIGN PATENT DOCUMENTS

| | | | |
|---|---|---|---|
| 9211911 | 7/1992 | World Int. Prop. O. | 273/155 |

*Primary Examiner*—Vincent Millin
*Assistant Examiner*—Steven B. Wong
*Attorney, Agent, or Firm*—Evenson, McKeown, Edwards & Lenahan

[57] ABSTRACT

A three-dimensional puzzle, which consists of several mutually connected puzzle elements which result in a regular tetrahedron in the assembled state. A number of identical tetrahedron-shaped puzzle elements and a number of mutually identical puzzle elements of different sizes are provided which all have the shape of a closed spatial frame. In this case, the development is such that the inner sides of the legs of the frame-shaped elements are identical to the outer sides of the frame legs of each of the next-smaller elements or to the surfaces of the smallest tetrahedron-shaped elements. All elements are in each case connected with one another along one of their edges, specifically such that they can be folded and can be pulled apart a distance at least on one end. In this case, the elements are arranged such that they form a number of chains which have different lengths, are each placed against one another with their largest element and consist of puzzle elements which all have different sizes.

6 Claims, 4 Drawing Sheets

THREE-DIMENSIONAL PUZZLE

BACKGROUND AND SUMMARY OF THE INVENTION

The invention is a three-dimensional puzzle game for adults and children which results in a regular tetrahedron in the assembled state. It is used for entertainment and for demonstrating a specific geometrical principle.

The main game value of known puzzles is the achieving of the more or less tricky task of creating an order out of disorder. The disassembling or mixing-up does not have any special appeal. This has the disadvantage that the interest in the puzzle will wane as soon as it is determined how it can be assembled correctly and can be solved.

The tetrahedron puzzles known from U.S. Pat. Nos. 3,565,442 and 4,323,245 as well as the tetrahedron puzzle known from German Design Patent G 88 08 167.2 also have this disadvantage. In the case of the latter, this disadvantage compensated by the fact that it can also be used for various purposes that are not game-related. In the case of the U.S. Pat. No. 4,323,245, this disadvantage is compensated by the fact that, in addition to the target shape, other bodies can also be built by means of these elements or groups of elements.

Another disadvantage of the known puzzles is that, even when they have a regular design, not much attention is paid to the geometrical principles on which the puzzles are based because the "pile of rubble" of the individual pieces stimulates thoughts on how the destroyed whole can be restored and not on according to which principle the individual pieces were shaped.

In addition, familiarity alone is a disadvantage in the case of puzzle games, and there is always a demand for new puzzles.

It is an object of the invention to provide a three-dimensional puzzle game which is surprising with respect to its unfamiliar pattern and creates particular interest. The puzzle should be entertaining not only when it is put together but also when it is taken apart. Also, the special characteristic of a tetrahedron, which is that it can be divided by only a few angular cuts into a plurality of elements shaped as regular spatial frames, is to be demonstrated in an impressive fashion.

This object is achieved by means of the characteristics described in claim 1.

The puzzle game comprises a specific number of similar elements of partly different sizes which are all permanently connected with one another to form a branched chain. The chain structure can be put together to form a filled-in regular tetrahedron.

Other objects, advantages and novel features of the present invention will become apparent from the following detailed description of the invention when considered in conjunction with the accompanying drawings.

DETAILED DESCRIPTION OF THE DRAWINGS

Figure 1A:
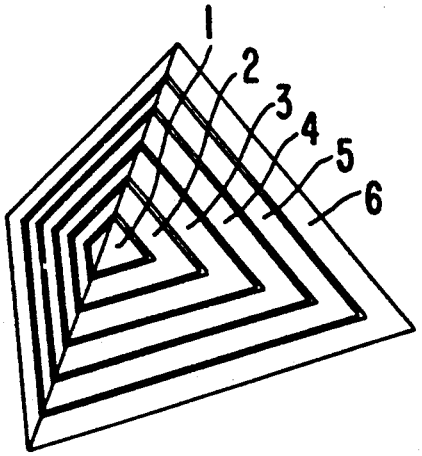
FIGS. 1*a* and 1*b* are views of an assembled puzzle.
Figure 1B:
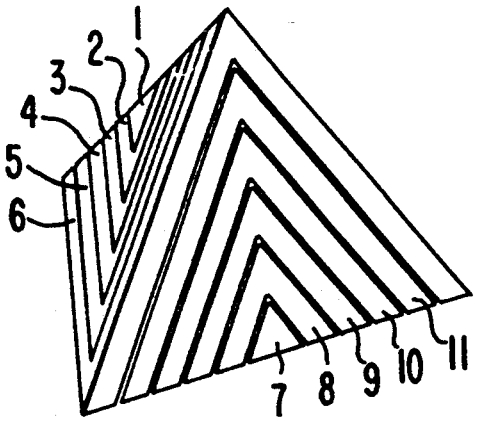

FIGS. 1*a* and 1*b* illustrate an embodiment of a puzzle assembled from 21 elements. It is a regular tetrahedron of which two surfaces respectively are visible in the drawing. In FIG. 1*a*, six puzzle elements 1 to 6 are visible on the two surfaces. FIG. 1*b* is a view of the puzzle that is rotated by 120 degrees; in this case, five additional elements 7 to 11 are visible.

Figure 2:
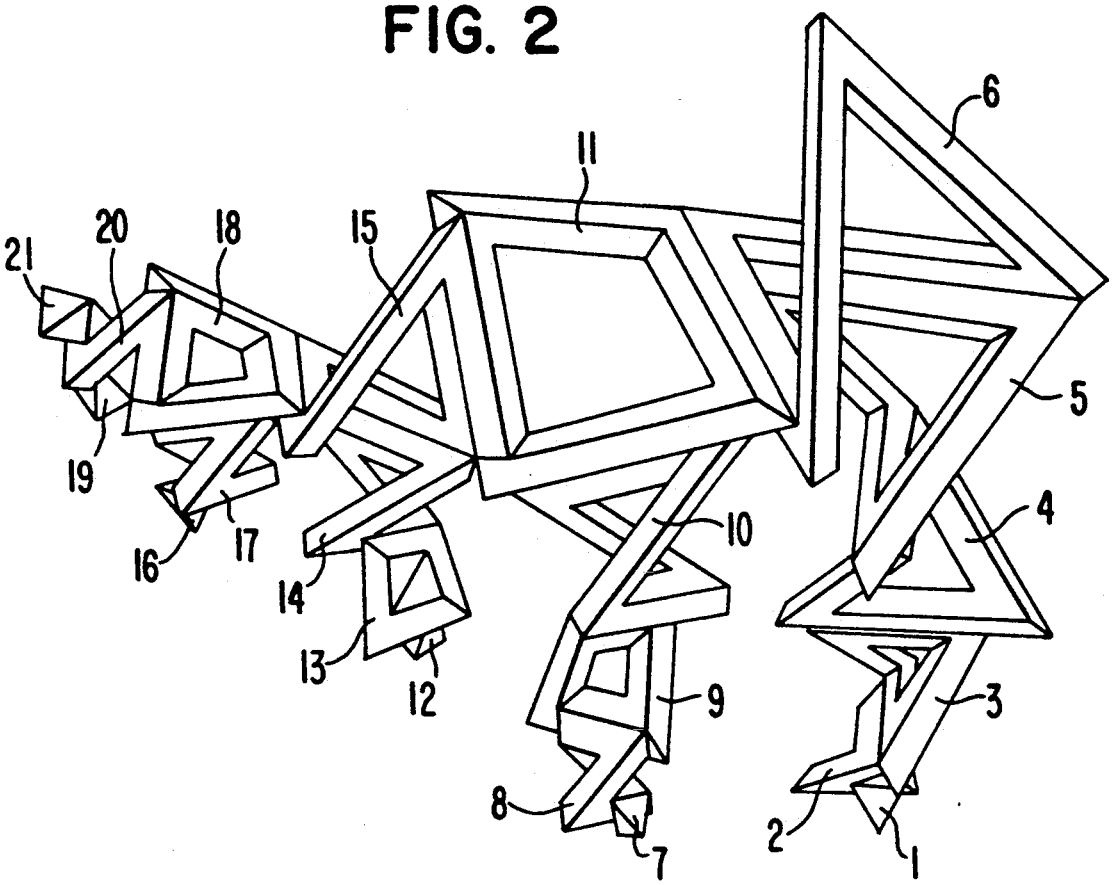
FIG. 2 is a view of a complete disassembled puzzle.

FIG. 2 shows the same embodiment as a completely disassembled puzzle with the elements 1 to 21.

The puzzle consists of a number of similar frame-shaped elements of different sizes and of a number of identical regular tetrahedrons which are the smallest puzzle elements. If the number of the smallest tetrahedron-shaped elements is n, there are n−1 mutually identical, next-larger, frame-shaped elements; n−2 next-larger to those, etc., and 1 largest frame-shaped element.

In FIG. 2, respective identical elements are the six tetrahedron-shaped elements 1, 7, 12, 16, 19, 21; the five frame-shaped elements 2, 8, 13, 17, 20; the four next-larger elements 3, 9, 14, 18; then the three elements 4, 10, 15; as well as the two second-largest elements 5 and 11. The largest element 6 occurs only once.

Figure 3A:
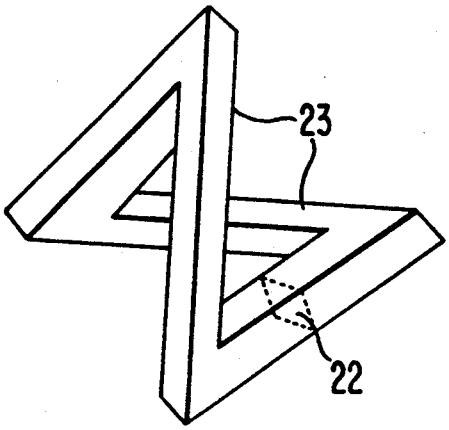
FIGS. 3*a*, 3*b* and 3*c* are views of three individually illustrated elements.
Figure 3B:
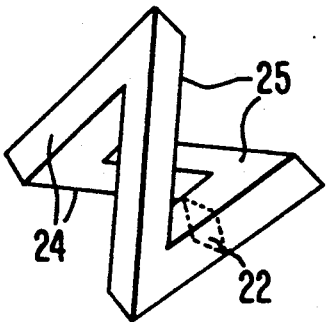
Figure 3C:
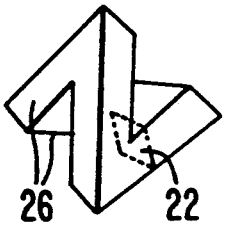

FIGS. 3*a*, 3*b*, and 3*c* illustrate examples of frame-shaped elements. Each of these elements consists of four frame legs of the same length and the same cross-section respectively, of which two legs respectively are arranged at a 60-degree angle with respect to one another. The cross-section of the legs has the shape of an equilateral lozenge. One leg cross-section 22 respectively is illustrated in FIGS. 3*a*, 3*b* and 3*c* by means of an interrupted line. The outer edges of the frame legs form four outer edges of a regular tetrahedron; so do the inner edges. Only in the case of the smallest frame-shaped elements, are the inner edges reduced to precisely one point. FIG. 3*c* shows such an element. In the case of all frame-shaped elements, the cross-section of the frame legs is the same; the elements differ only with respect to the length of their frame legs. The inner sides of the frame legs of an element are always identical with the outer sides of the frame leg of the next-smaller element, or, in the case of the smallest frame-shaped elements, with two surfaces of the tetrahedron-shaped puzzle elements. The inner surfaces 23 in FIG. 3*a* are identical with the outer surfaces 24 in FIG. 3*b*; so are the surfaces 25 and 26 in FIGS. 3*b* and 3*c*.

The number, shape and size of the puzzle elements are the result of several plane angular-cuts through the tetrahedron in parallel to its surfaces:

Two plane cuts always start on one tetrahedron edge, extend in parallel to one surface respectively at an acute angle toward one another, and end in a straight line in the interior of the tetrahedron which extends in parallel to the opposite edge. The distance to the respective surface is the same in the case of bath cuts.

Figure 4:
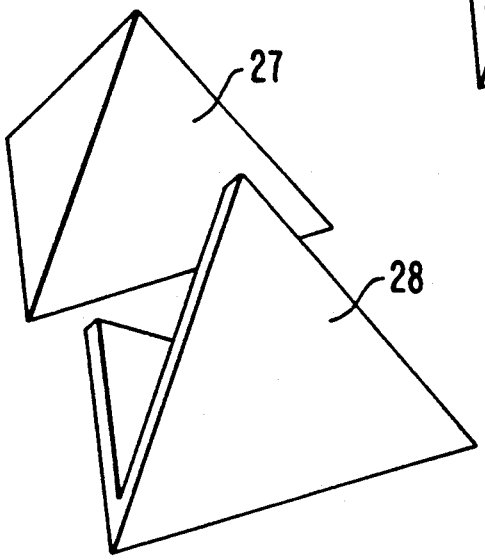
FIG. 4 is a schematic view concerning the principle of dividing the tetrahedron into the elements of the puzzle.

As a result of such an angular cut, a smaller tetrahedron and a tetrahedron half-shell are formed, as indicated in the schematic drawing of FIG. 4 as reference numbers 27 and 28.

Figure 5:
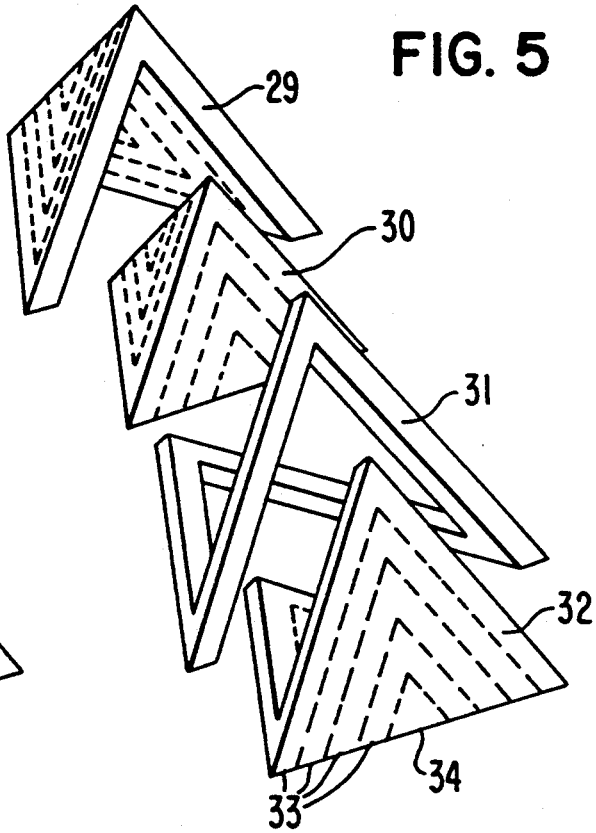
FIG. 5 is another schematic view of the dividing principle.

The same angular cut, taking place from the opposite tetrahedron edge, divides the tetrahedron half-shell 28 into a frame 31 and a smaller half-shell 32, and the tetrahedron 27 into a half-shell 29 and into a still smaller tetrahedron 30, as illustrated in the schematic drawing of FIG. 5.

By means of additional angular cuts of this type with equal distances from one another, a tetrahedron is divided into the pieces which make up the puzzle. In FIG. 5, the additional cuts to be made are indicated by an interrupted line.

In this case, the two opposite tetrahedron edges are divided from the outside toward the inside into equally long sections 33, and the section 34 formed by the angular center cut must have precisely twice the length of the other edge sections.

The embodiment with 21 puzzle elements illustrated in the drawing is based on a total of ten angular cuts, five respectively from the two opposite tetrahedron edges. Correspondingly, twelve angular cuts could result in 28 elements; eight angular cuts in only 15, etc.

All puzzle elements are permanently connected to form a branched chain. Two elements respectively are connected with one another along one of their edges.

Figure 6A:
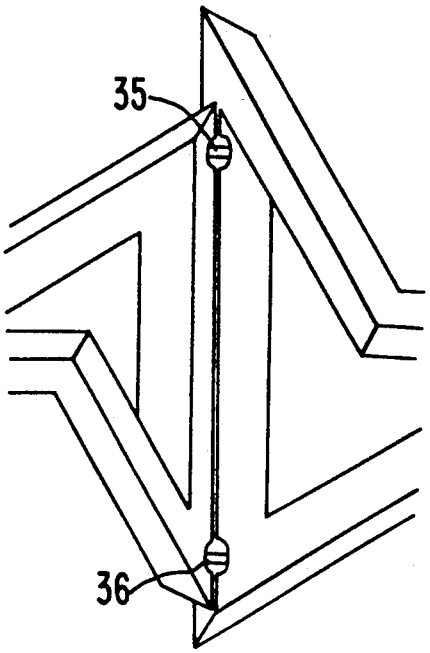
FIGS. 6*a* and 6*b* are views of the connection of two elements.
Figure 6B:
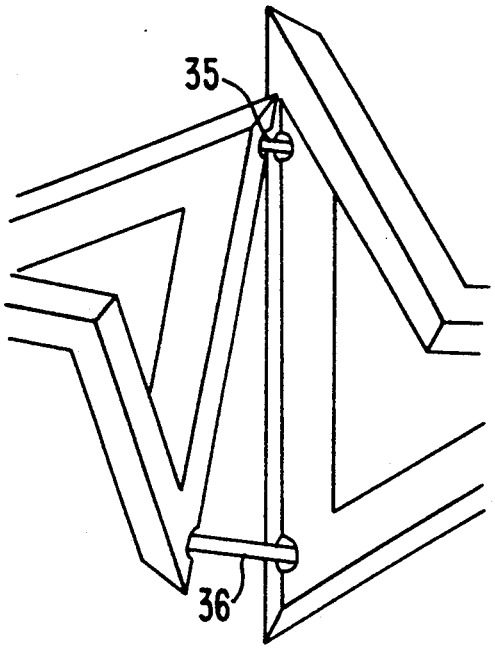

FIGS. 6*a* and 6*b* show the connection of two elements. The two connected edges have the same length and in the inoperative condition directly abut with one another along their whole length, as indicated in FIG. 6*a*. The connection is flexible so that the two puzzle pieces can be folded about the axis of their connected edges with respect to one another. The connection must also permit that the two piece edges can be pulled apart a little, as illustrated in FIG. 6*b*. In the illustrated embodiment, the edges are connected with one another by means of two elastic threads 35 and 36 which are each fastened on the inside of the elements or are pulled through to the next connecting point.

Figure 7A:
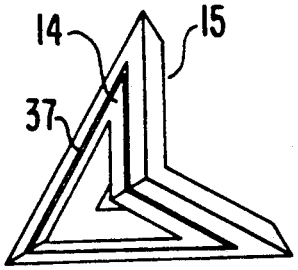
FIGS. 7*a*, 7*b* and 7*c* are views of the process of the folding-apart on the example of two puzzle elements.
Figure 7B:
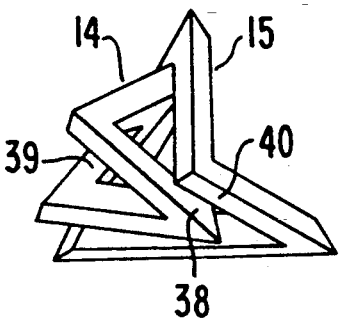
Figure 7C:
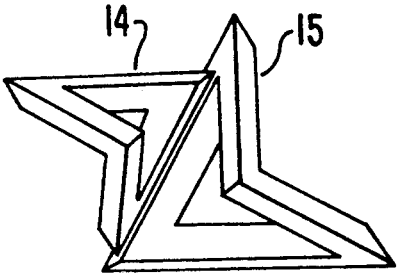

The extensibility of the edge connections is required for the folding-out of the puzzle elements which are fitted into one another. FIGS. 7*a*, 7*b* and 7*c* show this process on the example of two elements 14 and 15 in three steps: FIG. 7*a* shows the position of the two elements in the assembled tetrahedron. The elements are connected with one another along their edges 37. In FIG. 7*b*, the smaller element 14 is folded half-way toward the outside. So that its apex 38 can be moved past the frame leg 40 of the larger element, its frame leg 39 must be displaced slightly toward the outside, and for this purpose, the otherwise directly abutting edges of the two elements must be pulled apart. In FIG. 7*c*, the smaller element 14 is folded completely to the outside, and the connected edges of the two elements abut again directly with one another.

Figure 8:
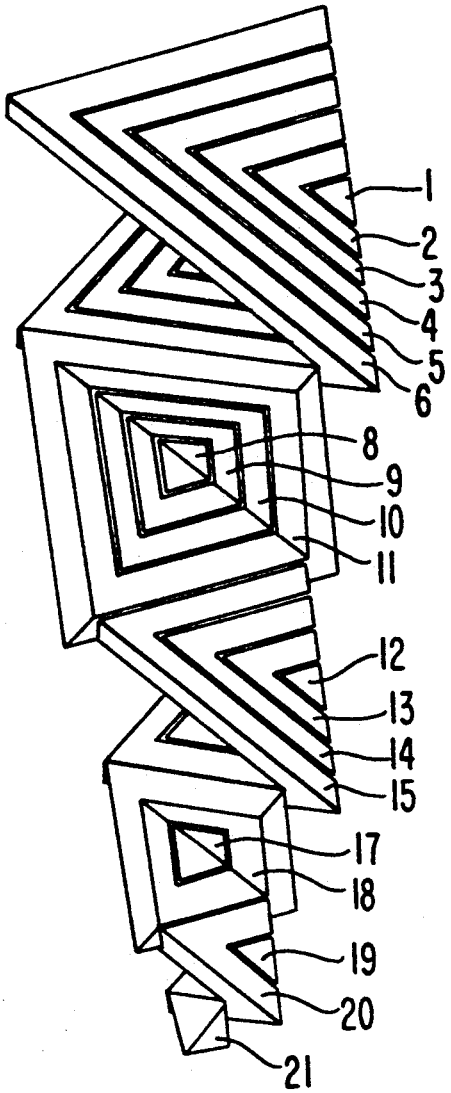
FIG. 8 is a view of a partially assembled puzzle.

FIGS. 2 and 8 show the arrangement of all puzzle elements in the chain structure. All elements, with the exception of one—a tetrahedron-shaped element—are combined to a number of chains. Each of these chains contains one element more than the preceding one; the shortest chain consists of two elements. In each chain, the puzzle elements are arranged to be rising according to their size, starting in each case with one of the smallest tetrahedron-shaped elements. In each case, the elements are connected on edges of two opposite frame legs with the next-smaller and next-larger element. In FIG. 2, the shortest chain consists of elements 19 and 20; it is followed by the chain consisting of three elements 16, 17, and 18, etc., to the longest chain with the elements 1 to 6.

As illustrated in FIG. 8, a tetrahedron half-shell can be assembled from each of these chains. The respective largest elements of all these chain as well as the remaining tetrahedron-shaped element are, in turn, connected with one another. In this case, the elements are again arranged according to their sizes, and the respective connecting edges are also situated on two opposite frame legs of the individual elements, specifically on such frame legs which otherwise have no connecting edge to another element.

This results in the branched chain structure illustrated in FIG. 2 which can be assembled to form the chain of tetrahedron half-shells which are placed next to one another and which is illustrated in FIG. 8, and finally in the filled-in tetrahedron.

The puzzle game may be manufactured from firm materials, such as metal, plastic, plexiglass, wood or cardboard. The puzzle bodies may be solid or hollow. The visual effect of the game can be heightened by different materials, a coloring or a surface treatment of the individual elements or of their individual surfaces.

The principle on which the puzzle game is based is well demonstrated in the case of 21 elements. The puzzle game becomes the more enticing and the puzzle itself becomes the more attractive aesthetically, the larger the number of elements.

It is the special attraction of this game that the transformation of the regular solid tetrahedron, which seems to be divided in a simple manner, into an airy structure of pieces that is seemingly in disorder and seems complicated, is surprising. The joy in this transformation is long lasting because during the disassembling or the assembling operation, the elements can be grouped in diverse, aesthetically very attractive variations so that the puzzle continues to be enticing. Although it looks complicated in the disassembled condition, the puzzle can be assembled quite easily so that one does not hesitate to play with it again.

It is possible to omit puzzle pieces which will later be disposed on the inside, such as pieces 21 or 19 to 21 so that a hollow space is formed on the inside of the tetrahedron for the accommodation of objects, such as a small perfume bottle or a piece of jewelry.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A three-dimensional puzzle comprising:

a plurality of identical tetrahedron-shaped puzzle elements, a plurality of sets of frame shaped elements, each set of frame shaped elements having a plurality of identical frame shaped elements with frame shaped elements of different ones of said sets having different dimensions, a single largest frame shaped element which is larger than the frame shaped elements of the sets of frame shaped elements, wherein each of said frame shaped elements have the shape of a closed spatial frame and consist of four legs arranged with respect to one another so that outer edges of the spacial frame form four edges of a first regular tetrahedron, and inner edges of the spacial frame a second regular tetrahedron which is smaller than the first regular tetrahedron, wherein inner sides of the legs of each frame shaped element have dimensions corresponding to outer sides of respective frame shaped elements of a next smaller set thereof, and permanent connection devices for connecting al puzzle elements with one another, said permanent connection devices serving to connect a respective pair of elements along respective ones of their edges directly with one another and allowing the pair of puzzle elements to be folded about an axis along their connected edges, aid connection devices being flexible and extensible to permit pulling apart of the connected edges at least on one end of the connected edges, and wherein the elements are arranged so that they form a number of chains of different lengths which are each placed against one another and consist of puzzle elements of different sizes, the individual elements in each of these chains being arranged in decreasing size order and each chain containing one puzzle element more than the preceding chain.

2. A three-dimensional puzzle according to claim 1, wherein each element within the chains of different lengths is connected on edges of two substantially opposite frame legs with the next larger and the next smaller element.

3. A three-dimensional puzzle according to claim 2 wherein the largest elements of each chain are placed next to one another and are connected on edges with corresponding frame legs of enlarged elements of adjacent chains.

4. A three-dimensional puzzle according to claim 1, wherein the largest elements of each chain are placed next to one another and are connected on edges with corresponding frame legs of enlarged elements of adjacent chains.

5. A three-dimensional puzzle according to claim 1, wherein all chains are placed adjacent one another at their respective largest element, starting with the longest chain and ending with a single tetrahedron puzzle element.

6. A three-dimensional puzzle according to claim 1, wherein the number of the smallest tetrahedron-shaped elements is n, there are n−1 next-larger frame-shaped elements, n−2 next-larger ones with respect to the latter, etc. and 1 largest frame-shaped element.

* * * * *